US009892676B2

(12) United States Patent
Cao et al.

(10) Patent No.: US 9,892,676 B2
(45) **Date of Patent: *Feb. 13, 2018**

(54) GATE DRIVING CIRCUIT PROVIDING A MATCHED GATE DRIVING SIGNAL, CORRESPONDING DRIVING METHOD, DISPLAY CIRCUIT AND DISPLAY APPARATUS

(71) Applicant: BOE TECHNOLOGY GROUP CO., LTD., Beijing (CN)

(72) Inventors: Kun Cao, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 88 days.

This patent is subject to a terminal disclaimer.

(21) Appl. No.: 14/787,934

(22) PCT Filed: Apr. 24, 2015

(86) PCT No.: PCT/CN2015/077384

§ 371 (c)(1),
(2) Date: Oct. 29, 2015

(87) PCT Pub. No.: WO2016/058352

PCT Pub. Date: Apr. 21, 2016

(65) Prior Publication Data

US 2016/0247446 A1 Aug. 25, 2016

(30) Foreign Application Priority Data

Oct. 17, 2014 (CN) ..... 2014 1 0555509

(51) Int. Cl.
*G09G 3/32* (2016.01)
*G09G 3/3225* (2016.01)
(Continued)

(52) U.S. Cl.
CPC ..... *G09G 3/3225* (2013.01); *G09G 3/3233* (2013.01); *G09G 3/3266* (2013.01);
(Continued)

(58) Field of Classification Search
CPC .. G09G 3/3225; G09G 3/3291; G09G 3/3233; G09G 3/3266; G09G 2320/0295;
(Continued)

(56) References Cited

U.S. PATENT DOCUMENTS

2005/0093464 A1* 5/2005 Shin ..... G09G 3/325 315/169.1
2005/0093804 A1 5/2005 Yamazaki et al.
(Continued)

FOREIGN PATENT DOCUMENTS

CN 1846243 A 10/2006
CN 1860519 A 11/2006
(Continued)

OTHER PUBLICATIONS

Chinese Office Action dated Feb. 29, 2016.
(Continued)

*Primary Examiner* — Kwang-Su Yang
(74) *Attorney, Agent, or Firm* — Dilworth & Barrese, LLP.; Michael J. Musella, Esq.

(57) ABSTRACT

A gate driving circuit (12, 13), a display circuit, a driving method thereof and a display apparatus are provided. The gate driving circuit (12, 13) comprises at least three GOA units, each of which comprises a signal input terminal (INPUT), an output terminal (OUT), a reset terminal (RESET) and an idle output terminal (COUNT). The gate driving circuit, the display circuit and the driving method and the display apparatus are capable of providing a
(Continued)

matched gate driving signal in the process of threshold compensation outside pixels and applicable to manufacture a displayer.

16 Claims, 8 Drawing Sheets

(51) Int. Cl.
*G09G 3/3291* (2016.01)
*G09G 3/3233* (2016.01)
*G09G 3/3266* (2016.01)

(52) U.S. Cl.
CPC ... *G09G 3/3291* (2013.01); *G09G 2300/0819* (2013.01); *G09G 2300/0842* (2013.01); *G09G 2310/0286* (2013.01); *G09G 2320/0295* (2013.01)

(58) Field of Classification Search
CPC ... G09G 2300/0819; G09G 2300/0842; G09G 2310/0286
See application file for complete search history.

(56) References Cited

U.S. PATENT DOCUMENTS

| | | | | |
|---|---|---|---|---|
| 2005/0280614 | A1 | 12/2005 | Goh | |
| 2007/0024546 | A1 | 2/2007 | Jang et al. | |
| 2007/0075938 | A1 | 4/2007 | Sung et al. | |
| 2008/0018629 | A1 | 1/2008 | Uchino et al. | |
| 2010/0053047 | A1 | 3/2010 | Chen | |
| 2010/0053233 | A1 | 3/2010 | Ishiguro et al. | |
| 2011/0279430 | A1 | 11/2011 | Koh | |
| 2012/0019499 | A1 | 1/2012 | Hwang | |
| 2014/0168282 | A1* | 6/2014 | Mun | G09G 3/3266 345/690 |
| 2015/0009113 | A1* | 1/2015 | Zeng | G09G 3/3677 345/100 |
| 2015/0145757 | A1 | 5/2015 | Asano | |
| 2016/0063961 | A1* | 3/2016 | Pyo | G09G 3/2022 345/213 |
| 2016/0247446 | A1 | 8/2016 | Cao et al. | |

FOREIGN PATENT DOCUMENTS

| | | | |
|---|---|---|---|
| CN | 1901017 | A | 1/2007 |
| CN | 101154342 | A | 4/2008 |
| CN | 101191920 | A | 6/2008 |
| CN | 101192381 | A | 6/2008 |
| CN | 101276548 | A | 10/2008 |
| CN | 101295481 | A | 10/2008 |
| CN | 100476941 | C | 4/2009 |
| CN | 101408684 | A | 4/2009 |
| CN | 101866619 | A | 10/2010 |
| CN | 201681587 | U | 12/2010 |
| CN | 102654968 | A | 9/2012 |
| CN | 103077662 | A | 5/2013 |
| CN | 103165079 | A | 6/2013 |
| CN | 103345941 | A | 10/2013 |
| CN | 103578411 | A | 2/2014 |
| CN | 103941439 | A | 7/2014 |
| CN | 104282269 | A | 1/2015 |
| CN | 104282270 | A | 1/2015 |
| JP | 2006251515 | A | 9/2006 |
| KR | 20060041045 | A | 5/2006 |
| KR | 20080010986 | A | 1/2008 |

OTHER PUBLICATIONS

ISR and WO dated Jul. 3, 2015.
International Search Report dated Jul. 15, 2015.
First Chinese Office Action dated Mar. 2, 2016.
International Preliminary Report dated Apr. 18, 2017.
Patent certificate dated Nov. 9, 2016.
Office action issued in U.S. Appl. No. 14/787,893 dated May 16, 2017.
Requirement for Restriction issued in U.S. Appl. No. 14/787,893 dated Feb. 24, 2017.

* cited by examiner

GATE DRIVING CIRCUIT PROVIDING A MATCHED GATE DRIVING SIGNAL, CORRESPONDING DRIVING METHOD, DISPLAY CIRCUIT AND DISPLAY APPARATUS

TECHNICAL FIELD

The present disclosure relates to a gate driving circuit, a display circuit, a driving method and a display apparatus.

BACKGROUND

Since a design of an organic light-emitting diode (OLED) pixel adopts a current-controlled type mostly, threshold voltages (Vth) of driving transistors of respective pixel units inside an entire panel are non-uniform and Vth offset produced after operation for a long period would reduce uniformity of displaying of the panel. Therefore, the above problem is avoided from occurring through a Vth compensation pixel design. In order to raise a process integration of an OLED display panel and at the same time reduce the cost, adopting gate driver on array (GOA) technology is a development trend in the future. However, the Vth compensation pixel design of OLED needs a peripheral gate driving circuit to cooperate therewith to provide a driving signal for performing the Vth compensation process. Therefore, a high requirement is set forth for the gate driving circuit.

In general, Vth compensation of pixels can be divided into threshold compensation within pixels and threshold compensation outside pixels. The way of compensation outside pixels is to provide a compensating signal to the pixels by disposing a threshold compensating unit outside the pixels. However, in the process of the threshold compensation, a peripheral gate driving circuit is needed to provide a matched gate driving signal.

SUMMARY

There are provided in some embodiments of the present disclosure a gate driving circuit, a display circuit, a driving method and a display apparatus, which are capable of providing a matched gate driving signal in the process of threshold compensation outside pixels.

In one aspect of the present disclosure, there is provided a gate driving unit comprising at least three GOA units, each of which comprises a signal input terminal, an output terminal, a reset terminal and an idle output terminal.

A signal input terminal of a first stage of GOA unit is input with a first frame start signal, and a reset terminal thereof is connected to an idle output terminal of a third stage of GOA unit.

A signal input terminal of a second stage of GOA unit is input with a second frame start signal.

A reset terminal of a 2n-th stage of GOA unit is connected to an idle output terminal of a (2n−1)-th stage of GOA unit and a signal input terminal of a (2n+1)-th stage of GOA unit.

A reset terminal of the (2n+1)-th stage of GOA unit is connected to an idle output terminal of a (2n+3)-th stage of GOA unit.

A signal input terminal of a (2n+2)-th stage of GOA unit is connected to an idle output terminal of a 2n-th stage of GOA unit.

An output terminal of the 2n-th stage of GOA unit and an output terminal of the (2n+1)-th stage of GOA unit output a gate driving signal to a pixel unit in a n-th row through a logic or unit, where n is a positive integer.

Optionally, the gate driving circuit further comprises a logic inverse unit disposed between the logic or unit and the pixel unit in the n-th row.

The output terminal of the 2n-th state of GOA unit and the output terminal of the (2n+1)-th stage of GOA unit are connected to an input terminal of the logic or unit, an output terminal of the logic or unit is connected to an input terminal of the logic inverse unit, and an output terminal of the logic inverse unit outputs the second gate driving signal, where n is a positive integer.

Optionally, the GOA unit comprises: a pull-up sub-circuit, a pull-down sub-circuit, a reset sub-circuit, an idle output sub-circuit and an output sub-circuit.

The pull-up sub-circuit is connected to the signal input terminal, a first level terminal, a first clock signal terminal, a second clock signal terminal, a first node, a second node, a third node and a fourth node, wherein the pull-up sub-circuit is configured to make a voltage of the first node consistent with the signal input terminal, make a voltage of the second node consistent with the signal input terminal or make the voltage of the second node consistent with a voltage of the fourth node, make a voltage of the third node consistent with a voltage of the first level terminal, and make the voltage of the fourth node consistent with a voltage of the first clock signal terminal under the control of signals of the signal input terminal, the first level terminal, the first clock signal terminal and the second clock signal terminal.

The pull-down sub-circuit is connected to a second level terminal, a third level terminal, the idle output terminal, the output terminal, a first node, a second node, a third node and a fourth node, and is configured to make a voltage of the third node consistent with that of the second level terminal under the control of a signal of the first node, make voltages of the first node and the second node and the second level terminal under a control of a signal of the third node, make a voltage of the output terminal and the second level terminal under the control of the signal of the third node, make a voltage of the output terminal and the third level terminal under the control of the signal of the third node, and make a voltage of the fourth node and the third level terminal under the control of the signal of the third node.

The reset sub-circuit is connected to the reset terminal, the second level terminal, the first node and the second node, and is configured to make the voltages of the first node and the second node consistent with the second level terminal under the control of a signal of the reset terminal.

The idle output sub-circuit is connected to the first node, the second clock signal terminal and the idle output terminal, and is configured to output a signal of the second clock signal terminal at the idle output terminal under the control of the first node.

The output sub-circuit is connected to the first node, the second clock signal terminal and the output terminal, and is configured to output the signal of the second clock signal terminal at the output terminal under the control of the first node.

Optionally, the idle output sub-circuit comprises: a first transistor, whose gate is connected to the first node, source is connected to the second clock signal terminal, and drain is connected to the idle output terminal.

Optionally, the pull-up sub-circuit comprises: a fourth transistor, a sixth transistor, a seventh transistor, an eleventh transistor, and a fourteenth transistor.

A gate and a source of the fourth transistor are connected to the first level terminal, and a drain thereof is connected to the second node.

A gate and a source of the sixth transistor are connected to the signal input terminal, and a drain thereof is connected to the second node.

A gate of the seventh transistor is connected to the first node, a source thereof is connected to the second clock signal terminal, and a drain thereof is connected to the fourth node.

A gate of the eleventh transistor is connected to the idle output terminal, a source thereof is connected to the second node, and a drain thereof is connected to the fourth node.

A gate of the fourteenth transistor is connected to the first clock signal terminal, a source thereof is connected to the second node, and a drain thereof is connected to the first node.

Optionally, the pull-down sub-circuit comprises: a second transistor, a third transistor, a fifth transistor, an eighth transistor, a tenth transistor and a thirteenth transistor.

A gate of the second transistor is connected to the third node, a source thereof is connected to the idle output terminal, and a drain thereof is connected to the second level terminal.

A gate of the third transistor is connected to the first node, a source thereof is connected to the third node, and a drain thereof is connected to the second level terminal.

A gate of the fifth transistor is connected to the third node, a source thereof is connected to the first node, and drain thereof is connected to the second node.

A gate of the eighth transistor is connected to the third node, a source thereof is connected to the fourth node, and a drain thereof is connected to the third level terminal.

A gate of the tenth transistor is connected to the third node, a source thereof is connected to the output terminal, and a drain thereof is connected to the third level terminal.

A gate of the thirteenth transistor is connected to the third node, a source thereof is connected to the second node, and a drain thereof is connected to the second level terminal.

Optionally, the reset sub-circuit comprises: a twelfth transistor and a fifteenth transistor.

A gate of the twelfth transistor is connected to the reset terminal, a source thereof is connected to the first node, and a drain thereof is connected to the second node.

A gate of the fifteenth transistor is connected to the reset terminal, a source thereof is connected to the second node, and a drain thereof is connected to the second level terminal.

Optionally, the output sub-circuit comprises a ninth transistor, whose gate is connected to the first node, source is connected to the second clock signal terminal, and drain is connected to the output terminal.

Optionally, the first frame start signal is a single pulse signal, and the second frame start signal is a multi-pulse signal.

Or, the second frame start signal is a single pulse signal, and a pulse width of the second frame start signal comprises at least two clock cycles of a clock signal input to the first gate driving circuit.

Optionally, m stages of GOA units are connected between the 2n-th stage of GOA unit and the (2n+2)-th stage of GOA unit in cascades.

According to another aspect of the present disclosure, there is provided a display circuit, comprising a pixel unit, a data voltage unit, and further comprising a first gate driving circuit and a second gate driving circuit.

The first gate driving circuit is any one of the gate driving circuit described above.

The second gate driving circuit is any one of the gate driving circuit described above.

The first gate driving circuit is configured to input a first gate driving signal to the pixel unit.

The second gate driving circuit is configured to input a second gate driving signal to the pixel unit.

The pixel unit is configured to perform threshold compensating and simultaneously display gray scale through the data voltage unit under a control of the first gate driving signal and the second gate driving signal.

According to another aspect of the present disclosure, there is provided a driving method of a display circuit, comprising following steps:

inputting a first gate driving signal to a pixel unit through a first gate driving circuit;

inputting a second gate driving signal to a pixel unit through a second gate driving circuit;

inputting a threshold compensating signal and a gray scale driving signal to the pixel unit through the data voltage unit; and controlling the pixel unit to perform threshold compensating according to the threshold compensating signal and simultaneously display gray scale according to the gray scale driving signal through the first gate driving signal and the second gate driving signal.

Optionally, the first gate driving signal and the second gate driving signal are multi-pulse signals.

Optionally, the first gate driving signal is a pulse signal comprising at least two kinds of pulse width, and/or the second gate driving signal is a pulse signal comprising at least two kinds of pulse width.

According to another aspect of the present disclosure, there is provided a display apparatus comprising the display circuit described above.

In the embodiments of the present disclosure, the first gate driving signal is input to the pixel unit through the first gate driving circuit, the second gate driving signal is input to the pixel unit through the second gate driving circuit, and the pixel unit is controlled through the first gate driving signal and the second gate driving signal to perform threshold compensating and gray scale displaying simultaneously. Threshold compensating and gray display displaying of the pixel unit can be performed simultaneously under the control of signals of two gate driving units, so that the matched gate driving signal is provided in the process of threshold compensating outside pixels.

DETAILED DESCRIPTION

A gate driving circuit, a display circuit, a driving method and a display apparatus provided in embodiments of the present disclosure will be described below in detail by combining with accompanying figures, wherein same figure references are used to indicate same elements in the present disclosure. In the following description, a large amount of specific details are given for the purpose of explaining, so as to provide comprehensive understanding of one or more embodiments. However, obviously, the embodiments can also be implemented without these specific details.

Switching transistors and driving transistors adopted in all the embodiments of the present disclosure can be thin film transistors or field effect transistors or other devices having the same characteristics. Since a source and a drain of a switching transistor adopted herein are symmetrical, the sources and drains can be exchanged with each other. In the embodiments of the present disclosure, in order to distinguish the two electrodes other than a gate of a transistor, one electrode is called as a source, and the other electrode is called as a drain. According to forms in the figures, it is prescribed that a middle terminal of a switching transistor is a gate, a signal input terminal thereof is a drain, and an output terminal thereof is a source. In addition, the switching transistor adopted in the embodiments of the present disclosure comprises a P type switching transistor and a N type switching transistor, wherein the P type switching transistor is turned on when the gate is at a low level and is turned off when the gate is at a high level, while the N type switching transistor is turned on when the gate is at the high level and is turned off when the gate is at the low level; a driving transistor comprises a P type and a N type, wherein the P type driving transistor is in an amplified state or in a saturated state when a gate voltage is at the low level (the gate voltage is smaller than a source voltage) and an absolute of a voltage difference between the gate and the source is greater than a threshold voltage; wherein the N type driving transistor is in an amplified state or in a saturated state when a gate voltage thereof is at the high level (the gate voltage is greater than the source voltage) and an absolute of a voltage difference between the gate and the source is greater than a threshold voltage.

Figure 1:
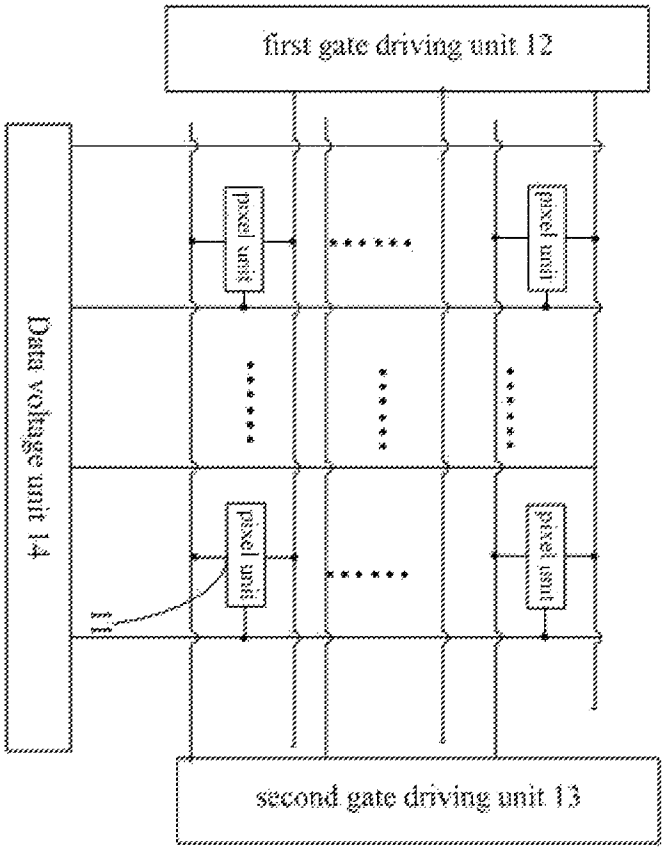
FIG. 1 is a schematic diagram of a configuration of a display circuit provided in an embodiment of the present disclosure.

FIG. 1 shows a schematic diagram of a configuration of a display circuit provided in an embodiment of the present disclosure. As shown in FIG. 1, the display circuit provided in the embodiment of the present disclosure comprises a pixel unit 11, a data voltage unit 14, a first gate driving circuit 12 and a second gate driving circuit 13.

In FIG. 1, the first gate driving circuit 12 is configured to input a first gate driving signal to the pixel unit 11;

the second gate driving circuit 13 is configured to input a second driving signal 13 to the pixel unit 11;

the pixel unit 11 is configured to perform threshold compensating and simultaneously display gray scale through the data voltage unit 14 under the control of the first gate driving signal and the second gate driving signal.

Herein, the pixel unit 11 is arranged in an array form generally. The data voltage unit 14 is capable of providing a data line signal with a threshold voltage compensating signal so as to perform threshold compensating on the pixel unit 11. The embodiments of the present disclosure do not limit the specific circuit configuration of the pixel unit 11. The pixel unit 11 controls operation timing by at least two gate driving signals.

In the circuit of FIG. 1, the first gate driving signal is input to the pixel unit through the first gate driving circuit; the second gate driving signal is input to the pixel unit through the second gate driving circuit; and the pixel unit is controlled by the first gate driving signal and the second gate driving signal to perform threshold compensating and gray scale displaying simultaneously. The threshold compensating and gray display displaying of the pixel unit can be performed simultaneously under the control of signals of two gate driving units, so that a matched gate driving signal is provided in the process of threshold compensation outside the pixels.

Figure 2:
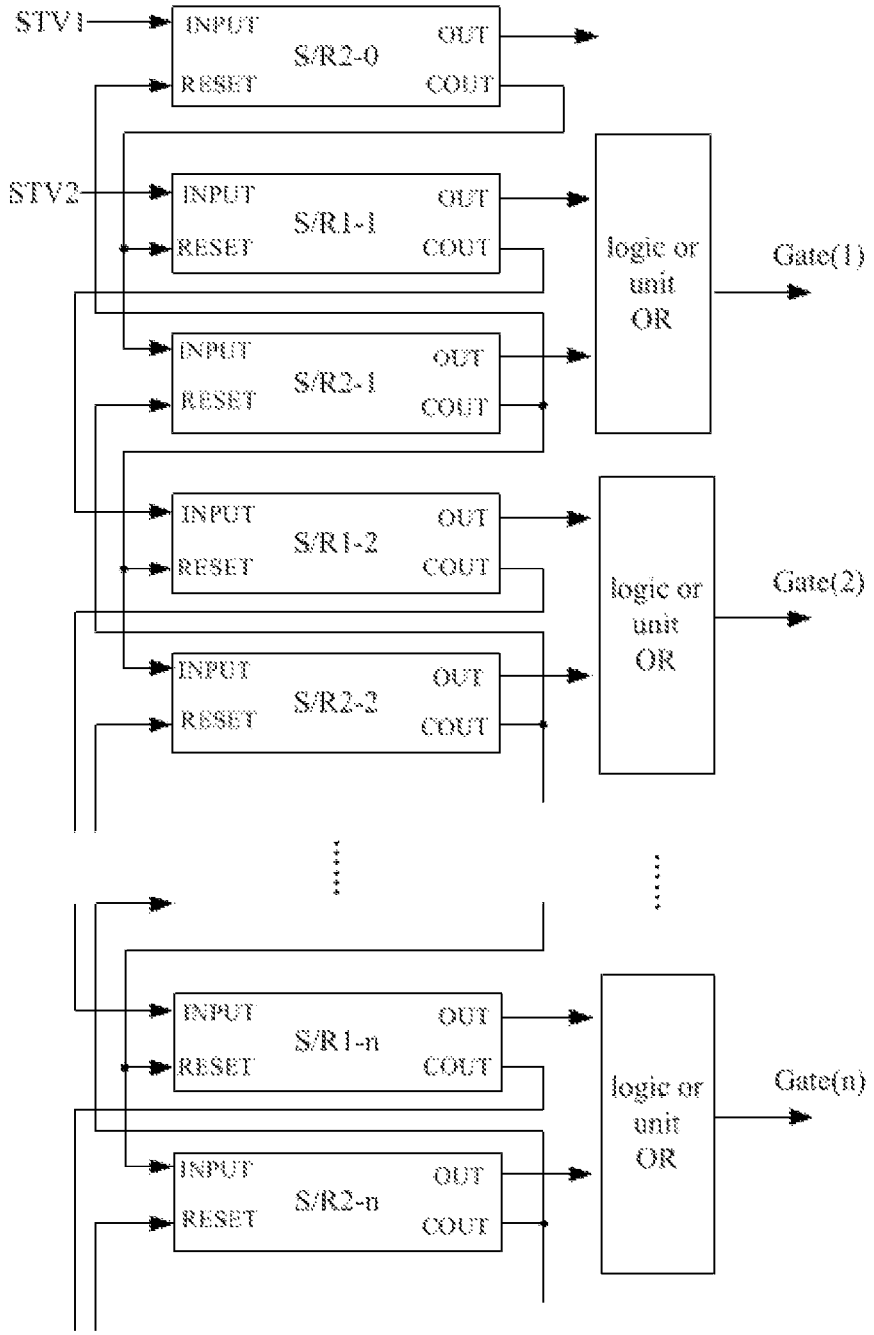
FIG. 2 is a schematic diagram of a configuration of a gate driving circuit provided in an embodiment of the present disclosure.

FIG. 2 shows a schematic diagram of a configuration of a gate driving circuit provided in an embodiment of the present disclosure. There are provided in the embodiments of the present disclosure exemplary configurations of the first gate driving circuit 12 and the second gate driving circuit 13. As shown in FIG. 2, there is provided in the embodiment of the present disclosure a gate driving circuit applied to the first gate driving circuit 12 and the second gate driving circuit 13 described above.

As shown in FIG. 2, the gate driving circuit comprises at least three GOA units, each of which comprises a signal input terminal INPUT, an output terminal OUT, a reset terminal RESET and an idle output terminal COUT.

In FIG. 2, the signal input terminal INPUT of a first stage of GOA unit (such as S/R2-0 shown in FIG. 2) is input with a first frame start signal STV 1, and the reset terminal thereof is connected to the idle output terminal COUT of a third stage of GOA unit.

The signal input terminal of a second stage of GOA unit (such as S/R1-1 shown in FIG. 2) is input with a second frame start signal STV2;

the reset terminal RESET of a 2n-th stage of GOA unit is connected to the idle output terminal COUT of a (2n−1)-th stage of GOA unit and the signal input terminal INPUT of a (2n+1)-th stage of GOA unit;

the reset terminal RESET of the (2n+1)-th stage of GOA unit is connected to the idle output terminal COUT of a (2n+3)-th stage of GOA unit;

the signal input terminal INPUT of a (2n+2)-th stage of GOA unit is connected to the idle output terminal COUT of a 2n-th stage of GOA unit;

the output sub-circuit OUT of the 2n-th stage of GOA unit and the output terminal OUT of the (2n+1)-th stage of GOA unit output a gate driving signal Gate(n) to a pixel unit in a n-th row through a logic or unit OR, where n is a positive integer.

Herein, it can be understood that the logic or unit OR is capable of superimposing signals of the output terminal OUT of the 2n-th stage of GOA unit and the output terminal OUT of the (2n+1)-th stage of GOA unit in time domain for output.

Figure 3:
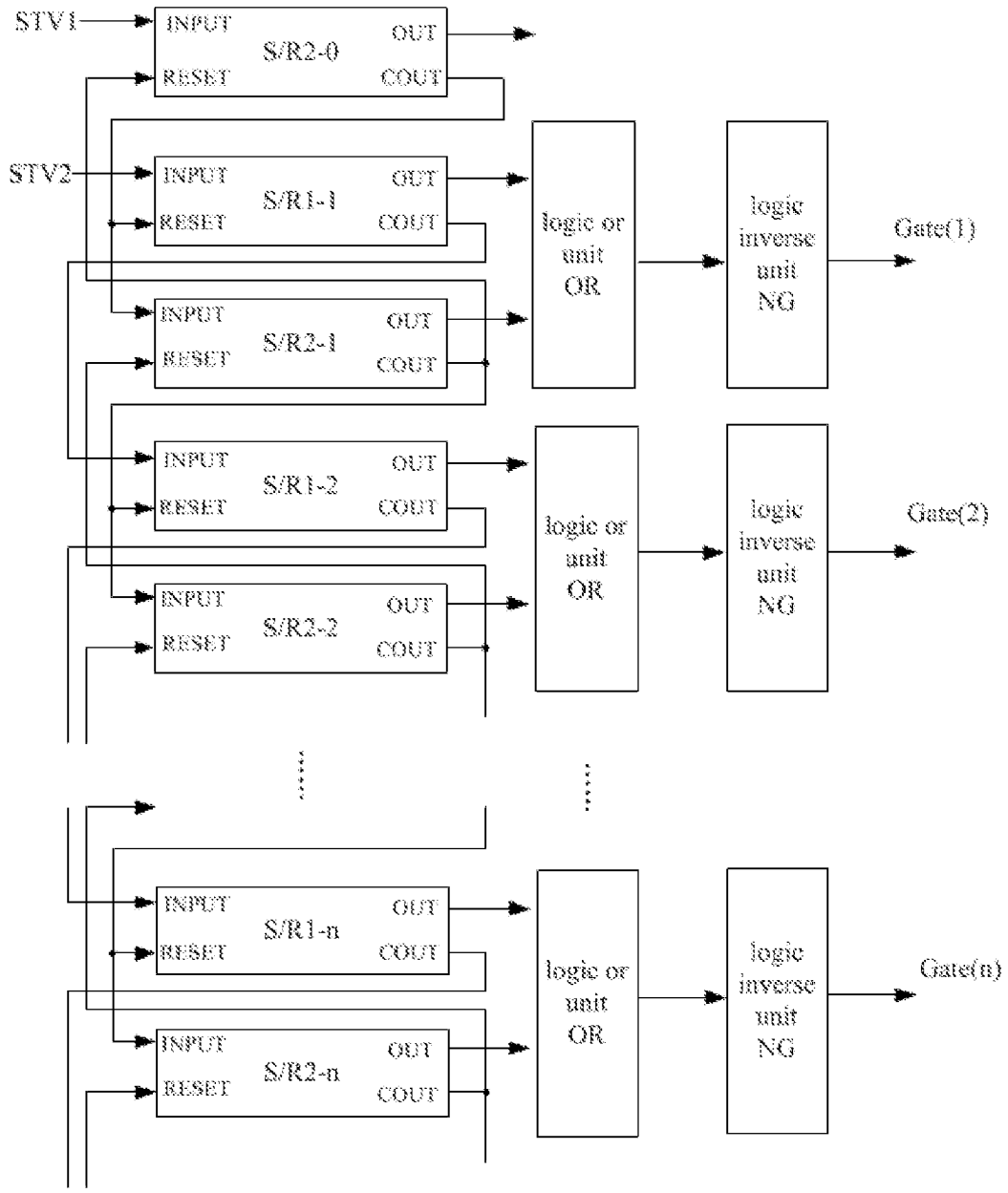
FIG. 3 is a schematic diagram of a configuration of a gate driving circuit provided in another embodiment of the present disclosure.

FIG. 3 shows a schematic diagram of configuration of a gate driving circuit provided in another embodiment of the present disclosure. Exemplarily, as shown in FIG. 3, by connecting the output terminal of the 2n-th stage of GOA unit and the output terminal of the (2n+1)-th stage of GOA unit to the input terminal of the logic or unit OR, and the output terminal of the logic or unit to the input terminal of the logic inverse unit NG, the gate driving signal Gate(n) can be output through the output terminal of the logic inverse unit NG. It can be understood that the logic inverse unit NG is capable of inverting 180° a signal of the input terminal of the logic or unit OR and then outputting the same.

Figure 4:
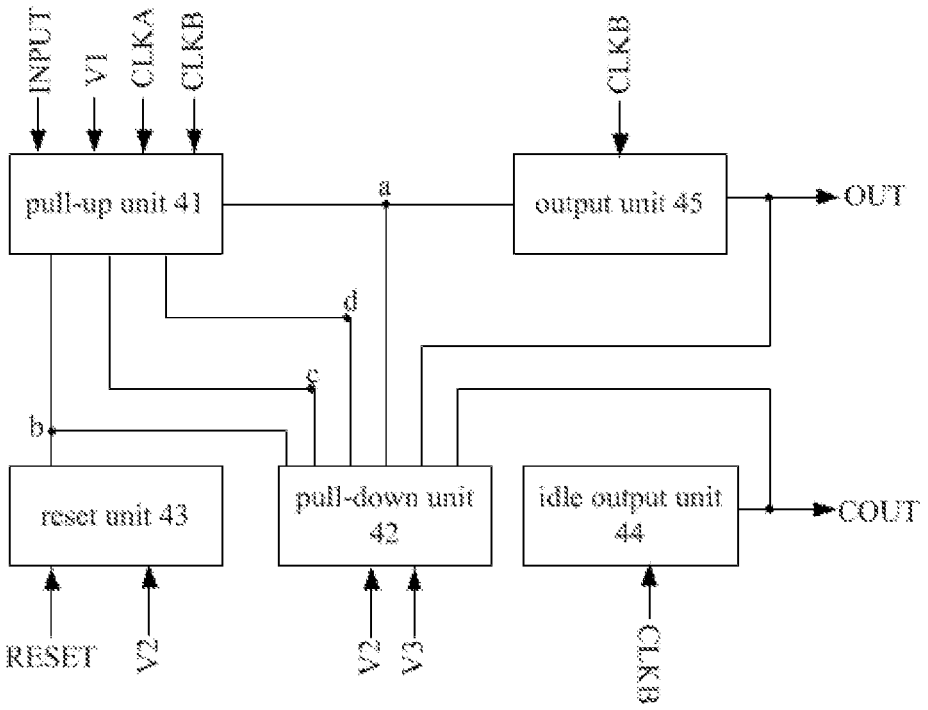
FIG. 4 is a schematic diagram of a configuration of a GOA unit provided in an embodiment of the present disclosure.

FIG. 4 shows a schematic diagram of configuration of a GOA unit provided in an embodiment of the present disclosure. Optionally, as shown in FIG. 4, the GOA unit comprises: a pull-up sub-circuit 41, a pull-down sub-circuit 42, a reset sub-circuit 43, an idle output sub-circuit 44 and an output sub-circuit 45.

In FIG. 4, the pull-up sub-circuit 41 is connected to the signal input terminal INPUT, a first level terminal V1, a first clock signal terminal CLKA, a second clock signal terminal CLKB, a first node a, a second node b, a third node c and a fourth node d. The pull-up sub-circuit 41 is configured to make a voltage of the first node a consistent with the signal input terminal INPUT, make a voltage of the second node b consistent with the signal input terminal INPUT or make the voltage of the second node b consistent with a voltage of the fourth node d, make a voltage of the third node c consistent with a voltage of the first level terminal V1, and make the voltage of the fourth node d consistent with a voltage of the first clock signal terminal CLKA under the control of signals of the signal input terminal INPUT, the first level terminal V1, the first clock signal terminal CLKA and the second clock signal terminal CLKB.

In FIG. 4, the pull-down sub-circuit. 42 is connected to a second level terminal V2, a third level terminal V3, the idle output terminal COUT, the output terminal OUT, the first node a, the second node b, the third node c and the fourth node d. The pull-down sub-circuit 42 is configured to make the voltage of the third node c consistent with the second level terminal V2 under the control of a signal of the first node a, make voltages of the first node a and the second node b consistent with the second level terminal V2 under the control of a signal of the third node c, make a voltage of the output terminal OUT consistent with the second level terminal V2 under the control of the signal of the third node c, make a voltage of the output terminal OUT consistent with the third level terminal V3 under the control of the signal of the third node c, and make a voltage of the fourth node d consistent with the third level terminal V3 under the control of the signal of the third node c.

In FIG. 4, the reset sub-circuit 43 is connected to the reset terminal RESET, the second level terminal V2, and the second node b, and is connected to the first node a through the pull-down sub-circuit 42; and is configured to make the voltages of the first node a consistent with the second node b and the second level terminal V2 under the control of a signal of the reset terminal RESET.

In FIG. 4, the idle output terminal 44 is connected to the second clock signal terminal CLKB and the idle output terminal COUT, and is connected to the first node a through the pull-down sub-circuit 42; and is configured to output a signal of the second clock signal terminal CLKB at the idle output terminal COUT under the control of the first node a.

In FIG. 4, the output sub-circuit 45 is connected to the first node a, the second clock signal terminal CLKB and the output terminal OUT. The output sub-circuit 45 is configured to output the signal of the second clock signal terminal CLKB at the output terminal OUT under the control of the first node a.

Figure 5:
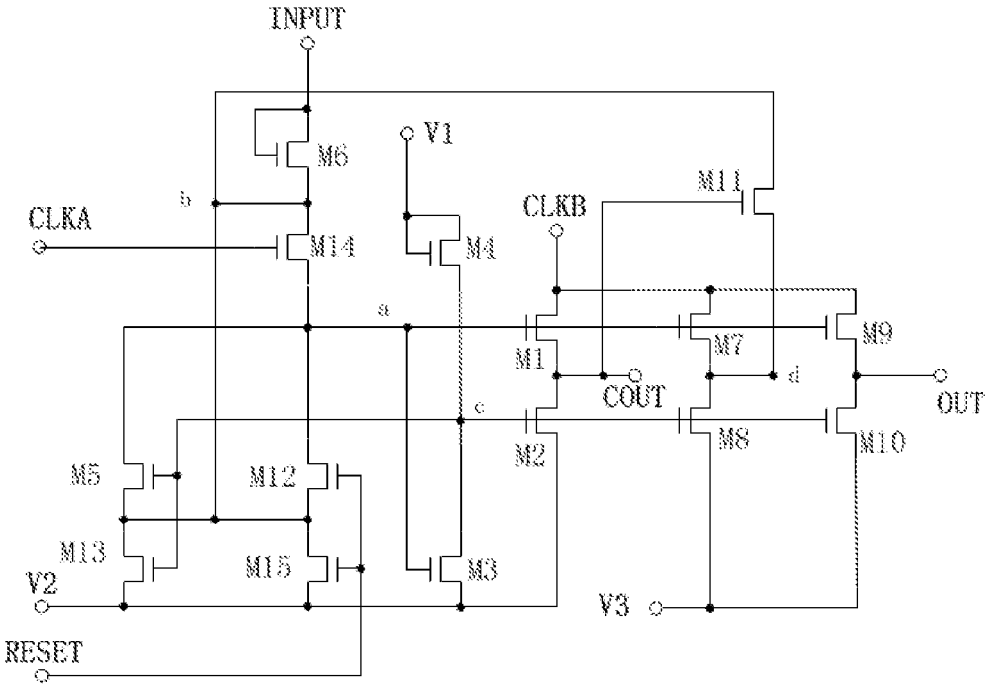
FIG. 5 is a schematic diagram of a configuration of a GOA unit provided in another embodiment of the present disclosure.

FIG. 5 shows a schematic diagram of configuration of a GOA unit provided in another embodiment of the present disclosure. Further, as shown in FIG. 5, in the GOA unit, the idle output sub-circuit comprises: a first transistor M1, whose gate is connected to the first node a, source is connected to the second clock signal terminal CLKB, and drain is connected to the idle output terminal COUT.

As shown in FIG. 5, the pull-up sub-circuit comprises: a fourth transistor M4, a sixth transistor M6, a seventh transistor M7, an eleventh transistor M11, and a fourteenth transistor M14.

A gate and a source of the fourth transistor M4 are connected to the first level terminal V1, and a drain thereof is connected to the third node c.

A gate and a source of the sixth transistor M6 are connected to the signal input terminal INPUT, and a drain thereof is connected to the second node b.

A gate of the seventh transistor M7 is connected to the first node a, a source thereof is connected to the second clock signal terminal CLKB, and a drain thereof is connected to the fourth node d.

A gate of the eleventh transistor M11 is connected to the idle output terminal COUT, a source thereof is connected to the second node b, and a drain thereof is connected to the fourth node d.

A gate of the fourteenth transistor M14 is connected to the first clock signal terminal CLKA, a source thereof is connected to the second node b, and a drain thereof is connected to the first node a.

As shown in FIG. 5, the pull-down sub-circuit comprises: a second transistor M2, a third transistor M3, a fifth transistor M5, an eighth transistor M8, a tenth transistor M10 and a thirteenth transistor M13.

A gate of the second transistor M2 is connected to the third node c, a source thereof is connected to the idle output terminal COUT, and a drain thereof is connected to the second level terminal V2.

A gate of the third transistor M3 is connected to the first node a, a source thereof is connected to the third node c, and a drain thereof is connected to the second level terminal v2.

A gate of the fifth transistor M5 is connected to the third node c, a source thereof is connected to the first node a, and drain thereof is connected to the second node b.

A gate of the eighth transistor M8 is connected to the third node c, a source thereof is connected to the fourth node d, and a drain thereof is connected to the third level terminal V3.

A gate of the tenth transistor M10 is connected to the third node c, a source thereof is connected to the output terminal OUT, and a drain thereof is connected to the third level terminal V3.

A gate of the thirteenth transistor M13 is connected to the third node c, a source thereof is connected to the second node b, and a drain thereof is connected to the second level terminal V2.

As shown in FIG. 5, the reset sub-circuit comprises: a twelfth transistor M12 and a fifteenth transistor M15.

A gate of the twelfth transistor M12 is connected to the reset terminal RESET, a source thereof is connected to the first node a, and a drain thereof is connected to the second node b.

A gate of the fifteenth transistor M15 is connected to the reset terminal RESET, a source thereof is connected to the second node b, and a drain thereof is connected to the second level terminal V2.

As shown in FIG. 5, the output sub-circuit comprises a ninth transistor M9, whose gate is connected to the first node a, source is connected to the second clock signal terminal CLKB, and drain is connected to the output terminal OUT.

Further, optionally, the first frame start signal is a single pulse signal, and the second frame start signal is a multi-pulse signal. Alternatively, the second frame start signal is a single pulse signal, and a pulse width of the second frame start signal comprises at least two clock cycles of a clock signal input to the first gate driving circuit.

Figure 6:
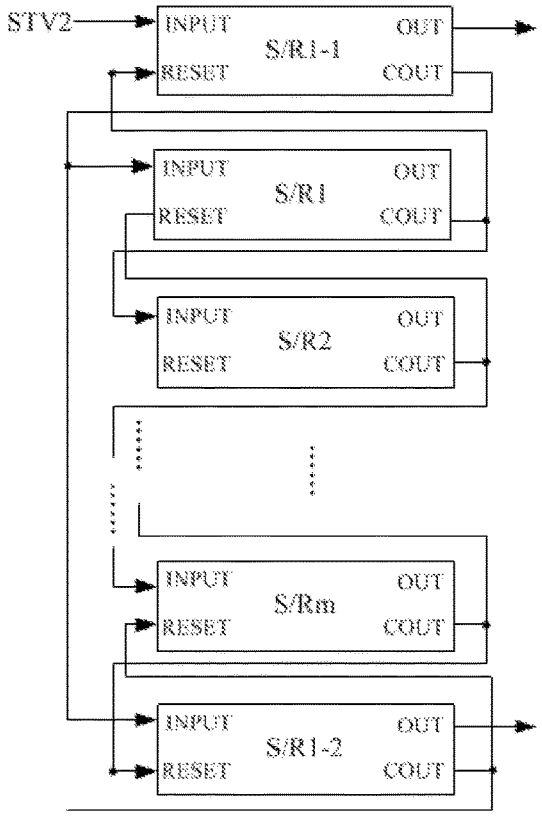
FIG. 6 is a schematic diagram of a configuration of connecting in cascades of a GOA unit provided in an embodiment of the present disclosure.

Further, in stages of GOA units are connected in cascades between the 2n-th stage of GOA unit and the (2n+2)-th stage of GOA unit. Exemplarily, as shown in FIG. 6, when n−1, the second frame start signal STV2 charges the control terminals (i.e., node a) of M1, M7, and M9. When the clock signals of CLKA and CLKB have a lower frequency, attenuation of the signal, at node a, would affect the normal operation of the GOA unit. Therefore, the m stages of GOA units are connected in cascades between the 2n-th stage of GOA unit and the (2n+2)-th stage of GOA unit and the frequency of the clock signals of CLKA and CLKB is correspondingly raised to avoid the influence of attenuation of the signal at node a on the GOA unit. Herein, the mode of connecting in cascades can be as follows: in the adjacent two GOA units, the idle output terminal COUT of a previous stage of GOA unit is connected to the signal input terminal INPUT of a next stage of GOA unit, and the reset terminal RESET of the previous stage of GOA unit is connected to the idle output terminal COUT of the next stage of GOA unit.

Figure 7:
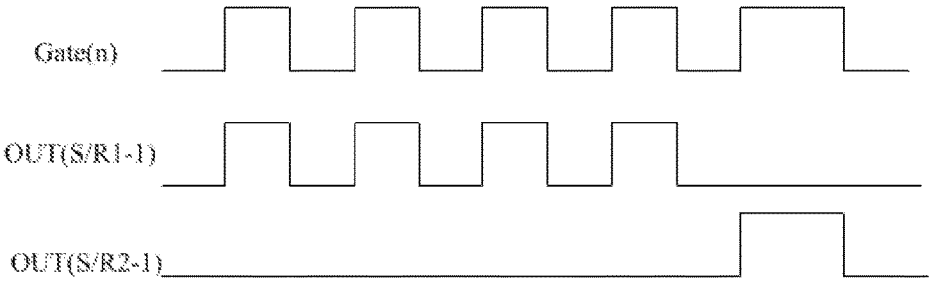
FIG. 7 is a schematic diagram of a timing signal provided in an embodiment of the present disclosure.
Figure 8:
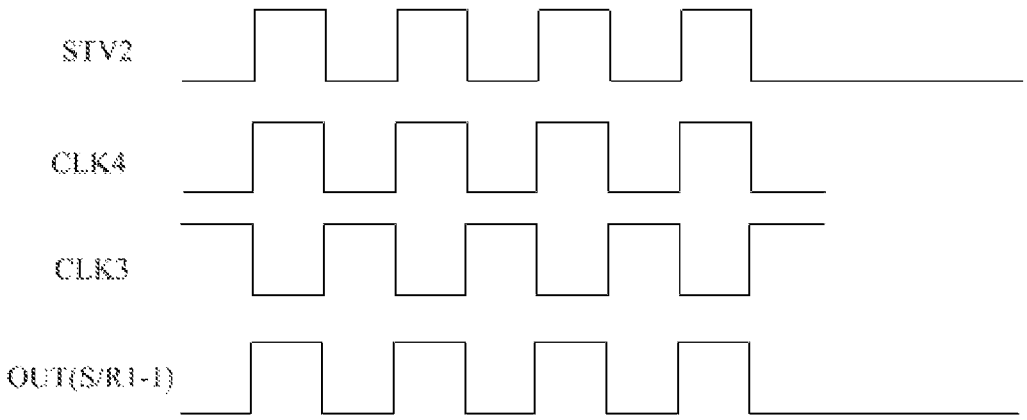
FIG. 8 is a schematic diagram of another timing signal provided in an embodiment of the present disclosure.
Figure 9:
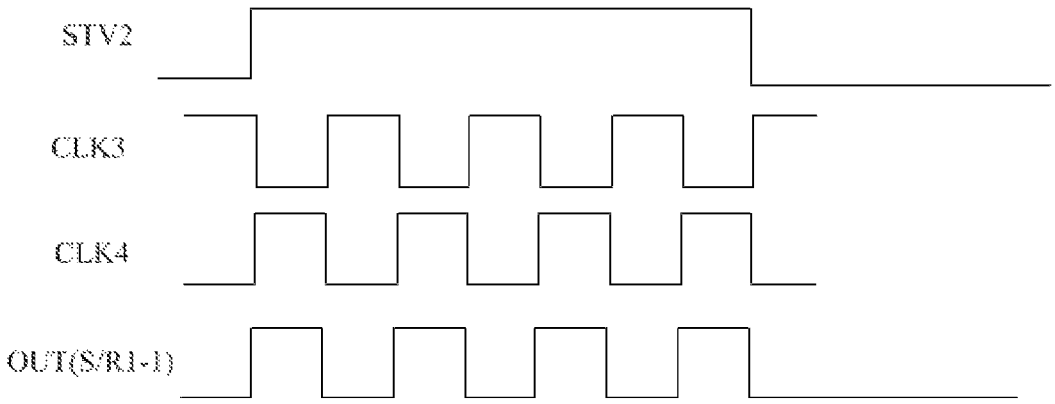
FIG. 9 is a schematic diagram of yet another timing signal provided in an embodiment of the present disclosure.

The operating process of the gate driving circuit will be described below by referring to the schematic diagrams of timing signals as shown in FIGS. 7, 8, and 9. Herein, the respective transistors in the GOA unit can be N type switching transistors or P type switching transistors. The description below takes the N type switching transistors as an example. In addition, the signal of the first level terminal V1 is a high level VGH, the signal of the second level terminal V2 is a first low level VGL1, and the signal of the third level terminal V3 is a second low level VGL2. As shown in FIG. 2, for the GOA unit in the gate driving circuit, the first clock signal terminal CLKA of the odd number stage of GOA units (such as S/R2-0, S/R2-1 shown in FIG. 2) is input with a first clock signal CLK1, the second clock signal terminal CLKB thereof is input with a second clock signal CLK2, and the signal input terminal INPUT of the first stage of GOA unit is input with a first frame start signal STV1; wherein CLK1 and CLK2 are a pair of clock signals having inverse phases, that is, CLK1 and CLK2 have a phase difference of 180°. For example, CLK1 and CLK2 have the same duty ratio (for example, their duty ratio is 50%), have the same frequency, and have a phase difference of 180°. A clock signal input to the first clock signal terminal CLKA of one GOA unit of two adjacent odd number stage of GOA units has a phase inverse to a clock signal input to the first clock signal terminal CLKA of another GOA unit of the two adjacent odd number stage of GOA units (i.e., having a phase difference of 180°). In the even number stage of GOA unit (such as S/R1-1, S/R1-2 shown in FIG. 2), the first clock signal terminal CLKA of the GOA unit S/R1-2*x* is input with a third clock signal CLK3, the second clock signal terminal CLKB thereof is input with a fourth clock signal CLK4, the first clock signal terminal CLKA of the GOA unit S/R1-(2*x*-1) is input with a fifth clock signal CLK5, and the second clock signal terminal CLKB thereof is input with a sixth clock signal CLK6; the signal input terminal INPUT of the second stage of GOA unit (S/R1-1) is input with a second frame start signal STV2; CLK3 and CLK4 are a pair of clock signals having inverse phases, that is, CLK3 and CLK4 have a phase difference of 180°. For example, CLK3 and CLK4 have the same duty ratio (for example, their duty ratio is 50%), have the same frequency, and have a phase difference of 180°. CLK5 and CLK6 are a pair of clock signals having inverse phases, that is, CLK5 and CLK6 have a phase difference of 180°. For example, CLK5 and CLK6 have the same duty ratio (for example, their duty ratio is 50%), have the same frequency, and have a phase difference of 180°. CLK3 and CLK5 have a preset phase difference. Exemplarily, CLK3 and CLK5 have a phase difference of 90° or 180°, or a pulse rising edge of CLK5 delays a quarter of cycle or a half of cycle than a pulse rising edge of CLK3. The frequency of CLK3 is different from that of CLK1, for example, the frequency of CLK3 is greater than that of CLK1, that is, the pulse width of CLK3 is smaller than that of CLK1; and the frequency of CLK5 is greater than that of CLK1, that is, the pulse width of CLK5 is smaller than that of CLK1. Exemplarily, the pulse width of CLK3 is 50% of the pulse width of CLK1; the pulse width of CLK5 is 50% of the pulse width of CLK1.

In FIG. 2, for the even number stages of GOA units in the gate driving unit, during the outputting process of the present stage, the respective transistors in the pull-up sub-circuit 41 are in a turn-on state, and the respective transistors in the pull-down sub-circuit 42 is in a turn-off state; the respective transistors in the reset sub-circuit 43 is in the turn-off state, and the respective transistors in the output sub-circuit 45 and the idle output sub-circuit 44 are in the turn-on state. As shown in FIG. 7, the output terminal of the second stage of GOA unit (S/R1-1) outputs a multi-pulse signal. As shown in FIG. 8, there is provided a specific implementing mode of the multi-pulse signal, and the second frame start signal STV2 is a multi-pulse signal. Alternatively, as shown in FIG. 9, the pulse width of the second frame start signal STV2 is adjusted so that the pulse width of STV2 comprises at least two clock cycles of the clock signal CLK4 input to the first gate driving circuit, that is, in the duration of one pulse width of STV2, CLK4 comprises four pulse signals. In view of FIG. 9, if the respective transistors are turned on at the high level, within a period of time of one high level pulse of STV2, when CLK4 is at the high level, the output sub-circuit is capable of taking the signal of CLK4 as the output signal of the second stage of GOA unit (S/R1-1). Since CLK4 comprises four pulse signals in the duration of one pulse width of STV2, the signal output from the output terminal of the second stage of GOA unit (S/R1-1) is the multi-pulse signal comprising four pulses. For the subsequent 2n-th stage of GOA unit, since the signal output from the COUT terminal of the (2n−2)-th stage of GOA unit is the multi-pulse signal, the input terminal INPUT of the 2n-th stage of GOA unit is also the multi-pulse signal (that is, a carry signal is also the multi-pulse signal). Therefore, the output terminal OUT of the 2n-th stage of GOA unit also obtains the output of the multi-pulse signal.

In the non-outputting process of the present stage, the respective transistors of the pull-up sub-circuit 41 are in the turn-off state, and the respective transistors in the pull-down sub-circuit 42 are in the turn-on state. The respective transistors in the reset sub-circuit 43 are in the turn-on state, and the respective transistors in the output sub-circuit 45 and the idle output sub-circuit 44 are in the turn-off state. At this time, the OUT terminal of the output sub-circuit 45 does not output, and the COUT terminal of the idle output terminal 44 does not output either.

For the odd number stages of GOA units in the gate driving circuit, during the outputting process of the present stage of GOA unit, the respective transistors in the pull-up sub-circuit 41 are in the turn-on state, and the respective transistors in the pull-down sub-circuit 42 are in the turn-off state; the respective transistors in the reset sub-circuit 43 are in the turn-off state, and the respective transistors in the output sub-circuit 45 and the idle output sub-circuit 44 are in the turn-on state. Exemplarily, as shown in FIG. 8, the output terminal of the third stage of GOA unit (S/R2-1) outputs a single pulse signal, and thus the odd number stages of GOA unit sequences in the gate driving unit output the single pulse signal, which is a conventional mode and thus is not described in detail in the embodiments of the present disclosure by combing with timing diagrams of STV1, CLK1 and CLK2. In the non-outputting process of the present stage of GOA unit, the respective transistors in the pull-up sub-circuit 41 are in the turn-off state, and the respective transistors in the pull-down sub-circuit 42 are in the turn-on state; the respective transistors in the reset sub-circuit 43 are in the turn-on state, and the respective transistors in the output sub-circuit 45 and the idle output sub-circuit 44 are in the turn-off state. At this time, the OUT terminal of the output sub-circuit 45 does not output, and the COUT terminal of the idle output sub-circuit 44 does not output either.

The output signal of the 2n-th stage of GOA unit and the output signal of the (2n+1)-th stage of GOA unit are superimposed by the logic or unit OR for outputting to obtain the gate driving signal Gate(n) of the pixel unit in the n-th row. As shown in FIG. 7, the multi-pulse signal comprising four pulses and outputting from the output terminal of the second stage of GOA unit (S/R1-1) and the single pulse signal outputting from the output terminal of the third stage of GOA unit (S/R2-1) are superimposed and output to obtain Gate(1). Since the pulse width of CLK3 is smaller than that of CLK1 and the pulse width of CLK5 is smaller than that of CLK1, Gate(1) comprises one wide pulse signal and at least one narrow pulse signal with a fixed waveform. In FIGS. 7-9, Gate(n) comprising one wide pulse signal and four narrow pulse signals with a fixed waveform is just an example, to which the embodiments of the present disclose are not limited, and there may be a combination of other forms.

For the operation principle of the gate driving unit as shown in FIG. 3, only a logic inverse unit is added in the gate driving unit as shown in FIG. 3 with respect to the gate driving unit as shown in FIG. 2, and thus it is only that the gate driving signal output by the gate driving unit as shown in FIG. 2 is used as the gate driving signal after being inversed a phase of 180°. The specific principle is not repeated any more herein. The gate driving unit provided in the embodiments described above provides the first gate driving signal Gate1 to the pixel unit when being used as the first gate driving circuit 12, and provides the second gate driving signal Gate2 to the pixel unit when being used as the second gate driving circuit 13.

Figure 10:
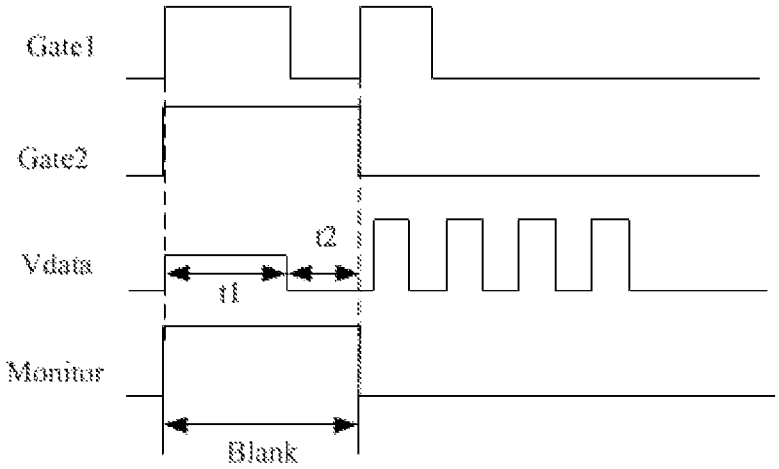
FIG. 10 is a schematic diagram of another timing signal provided in an embodiment of the present disclosure.

FIG. 10 shows a schematic diagram of another timing signal provided in an embodiment of the present disclosure. Referring to the schematic diagram of the timing signal as shown in FIG. 10, there is provided a timing diagram of a driving signal of a threshold voltage compensation outside an active matrix/organic light emitting diode (AMOLED).

Figure 11:
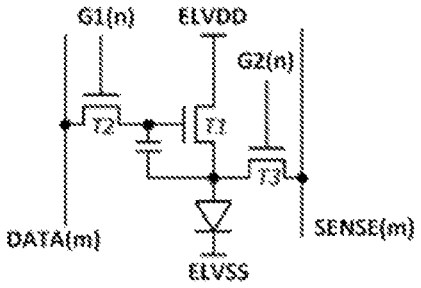
FIG. 11 is a schematic diagram of a configuration of a pixel unit provided in an embodiment of the present disclosure.

FIG. 11 shows a schematic diagram of configuration of a pixel unit provided in an embodiment of the present disclosure. FIG. 10 comprises the first gate driving signal Gate1, the second gate driving signal Gate2, the data line signal Vdata and a pixel current monitoring signal Monitor provided to the pixel unit 11 in FIG. 11. The data voltage unit 14 as shown in FIG. 1 is capable of adjusting the data line signal Vdata provided to the pixel unit 11 according to the monitored pixel current, so that external compensation of threshold voltage is realized. The pixel circuit provided in the embodiment comprises three transistors T1, T2, T3 and one capacitor, wherein a control terminal G1(*n*) of T2 is input with the first gate driving signal Gate1 corresponding to a n-th frame, an input terminal DATA(m) of T2 is input with the data line signal Vdata in a m-th row, an output terminal of T2 is connected to a control terminal of T1, an input terminal of T1 is input with an operation positive voltage ELVDD of OLED, an output terminal of T1 is connected to an anode of OLED, a cathode of OLED is input with an operation negative voltage ELVSS, a control terminal G2(*n*) of T3 is input with the second gate driving signal Gate2 corresponding to the n-th frame, an input terminal of T3 is connected to the output terminal of T1, an output terminal SENSE(m) of T3 outputs the pixel current monitoring signal Monitor in the m-th row, and the capacitor is disposed between the control terminal and output terminal of T1.

The gate driving circuit provided in the above embodiments provides the first gate driving signal Gate1 and the second gate driving signal Gate2 to the pixel unit 11. During a period of time Blank, Gate2 controls T3 to be turned on to monitor the pixel current monitoring signal Monitor, so as to perform threshold voltage compensation. During a period of time t1, the data line Data is input with a reference signal Vref, and during this period of time t1, Gate1 controls T2 to be turned on to extract the pixel current monitoring signal Monitor. During a period of time t 2, Gate(1) controls T2 to be turned off, and the data voltage unit 14 provides the data line signal with the threshold compensating signal and the gray scale driving signal according to the pixel current monitoring signal.

Figure 12:
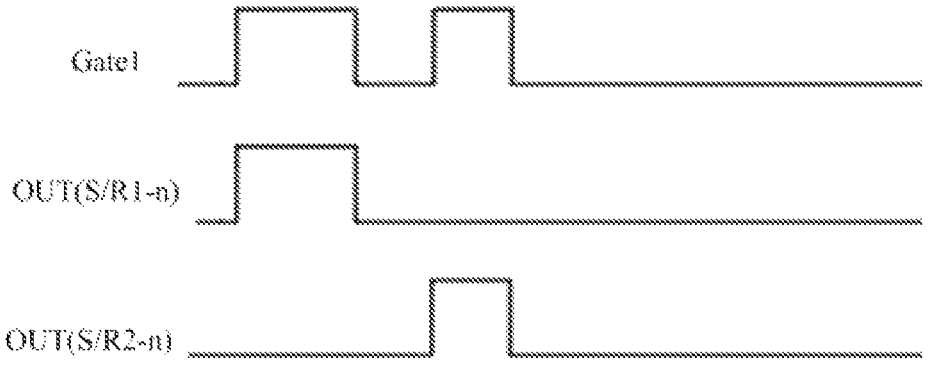
FIG. 12 is a schematic diagram of another timing signal provided in an embodiment of the present disclosure.

FIG. 12 shows a schematic diagram of another timing signal provided in the embodiments of the present disclosure. In addition, the first gate driving signal Gate1 can be realized in a manner described in the embodiments corresponding to FIGS. 7-9. Now, it only needs to adjust the clock signals of the GOA units and the input frame start signals, so that the GOA units S/R1-*n* and S/R2-*n* in the gate driving circuit as shown in FIG. 2 output the timing signals as shown in FIG. 12, and superimpose the signals by the logic or unit OR for outputting as the first gate driving signal Gate(1). Similarly, the second gate driving signal Gate2 can also be generated by referring to the above method, and thus no further description is repeated herein.

Of course, the timing states of the first gate driving signal generated by the first gate driving circuit 12 and the second gate driving signal generated by the second gate driving circuit 13 provided in the exemplary embodiments described above are just a possible implementation form. When the clock signal and the frame start signal input to the GOA unit are adjusted, the first gate driving signal and the second gate driving signal of other timing states may be generated to be output, to which no specific limitation is made.

In the exemplary embodiments described above, the first gate driving signal is input to the pixel unit through the first gate driving circuit; the second gate driving signal is input to the pixel unit through the second gate driving circuit; and the pixel unit is controlled by the first gate driving signal and the second gate driving signal to perform threshold compensating and gray scale displaying simultaneously. Since the threshold compensating and the gray display displaying of the pixel unit can be performed simultaneously under the control of signals of two gate driving units, the matched gate driving signal is provided in the process of external threshold compensating of pixels.

Figure 13:
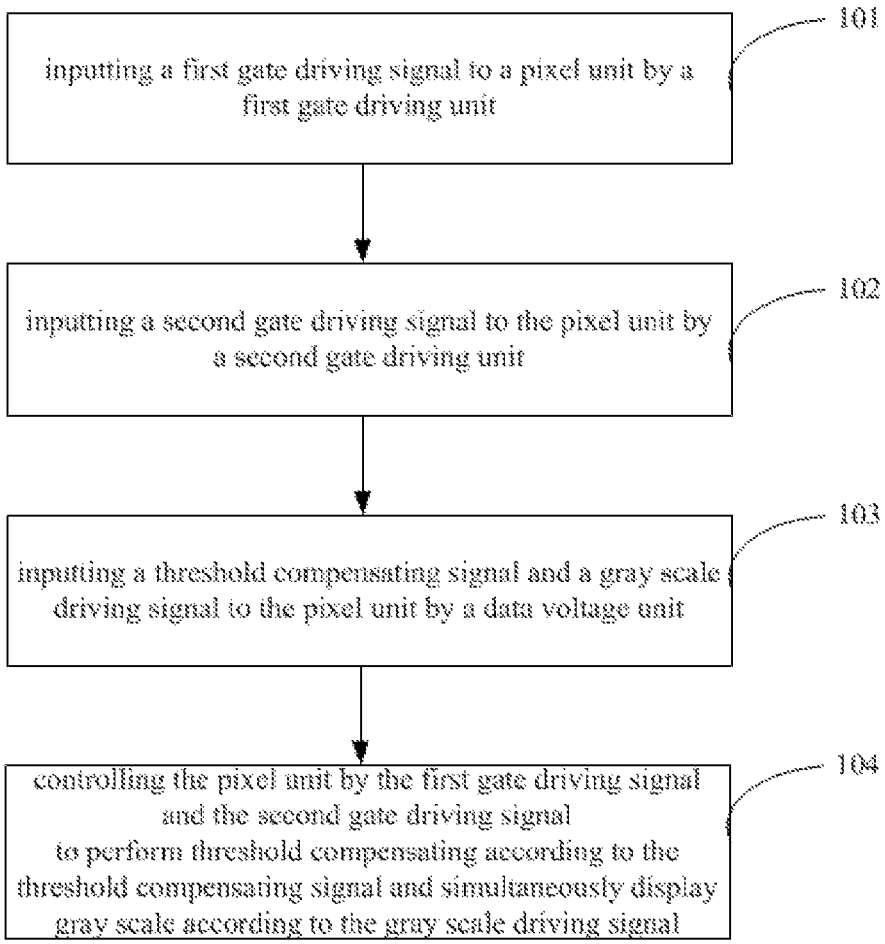
FIG. 13 is a flow schematic diagram of a driving method of a display circuit provided in an embodiment of the present disclosure.

FIG. 13 shows a flow schematic diagram of a driving method of a display circuit provided in embodiments of the present disclosure. As shown in FIG. 13, there is provided in the embodiments of the present disclosure a driving method of the display circuit, comprising following steps:

in step 101, a first gate driving signal is input to a pixel unit by a first gate driving circuit;

in step 102, a second gate driving signal is input to a pixel unit by a second gate driving circuit;

in step 103, a threshold compensating signal and a gray scale driving signal are input to the pixel unit by a data voltage unit; and in step 104, the pixel unit is controlled by the first gate driving signal and the second gate driving signal to perform threshold compensating according to the threshold compensating signal and display the gray scale according to the gray scale driving signal simultaneously.

Optionally, the first gate driving signal and the second gate driving signal are multi-pulse signals. Optionally, the first gate driving signal is a pulse signal comprising at least two kinds of pulse width, and/or the second gate driving signal is a pulse signal comprising at least two kinds of pulse width.

In the driving method of the display circuit, the first gate driving signal is input to the pixel unit through the first gate driving circuit, the second gate driving signal is input to the pixel unit through the second gate driving circuit, and the pixel unit is controlled through the first gate driving signal and the second gate driving signal to perform threshold compensating and gray scale displaying simultaneously. Threshold compensating and gray display displaying of the pixel unit can be performed simultaneously under the control of signals of two gate driving units, so that the matched gate driving signal is provided in the process of external threshold compensation of pixels.

There is further provided in embodiments of the present disclosure a display apparatus, comprising any one of the display circuits described above. The display circuit comprises a pixel unit, a first gate driving circuit and a second gate driving circuit. The display apparatus can be a display device such as an electronic paper, a mobile phone, a TV set, a digital photo frame, etc.

The above descriptions are just specific implementations of the present disclosure. The protection scope of the present disclosure is not limited thereto. Any alternation or replacement that can be easily conceived for those skilled in the art who are familiar with the technical field within the technical scope disclosed by the present disclosure shall fall into the protection scope of the present disclosure. Therefore, the protection scope of the present disclosure shall be subjected to the protection scope of the claims.

The present application claims the priority of a Chinese patent application No. 201410555509.2 filed on Oct. 17, 2014. Herein, the content disclosed by the Chinese patent application is incorporated in full by reference as a part of the present disclosure.

What is claimed is:

1. A gate driving circuit, comprising at least three gate driver on array (GOA) units, each of which comprises: a signal input terminal; an output terminal; a reset terminal; and an idle output terminal, wherein a signal input terminal of a first stage of GOA unit is input with a first frame start signal, and a reset terminal thereof is connected to an idle output terminal of a third stage of GOA unit;

a signal input terminal of a second stage of GOA unit is input with a second frame start signal;

a reset terminal of a 2n-th stage of GOA unit is connected to an idle output terminal of a (2n−1)-th stage of GOA unit and a signal input terminal of a (2n+1)-th stage of GOA unit;

a reset terminal of the (2n+1)-th stage of GOA unit is connected to an idle output terminal of a (2n+3)-th stage of GOA unit;

a signal input terminal of a (2n+2)-th stage of GOA unit is connected to an idle output terminal of a 2n-th stage of GOA unit; and an output terminal of the 2n-th stage of GOA unit and an output terminal of the (2n+1)-th stage of GOA unit output a gate driving signal to a pixel unit in a n-th row through a logic or unit, where n is a positive integer.

2. The gate driving circuit according to claim 1, wherein the GOA unit comprises: a pull-up sub-circuit, a pull-down sub-circuit, a reset sub-circuit, an idle output sub-circuit and an output sub-circuit;

the pull-up sub-circuit is connected to the signal input terminal, a first level terminal, a first clock signal terminal, a second clock signal terminal, a first node, a second node, a third node and a fourth node, wherein the pull-up sub-circuit is configured to make a voltage of the first node consistent with that of the signal input terminal, make a voltage of the second node consistent with that of the signal input terminal or make the voltage of the second node consistent with a voltage of the fourth node, make a voltage of the third node consistent with a voltage of the first level terminal, and make the voltage of the fourth node consistent with a voltage of the first clock signal terminal under the control of signals of the signal input terminal, the first level terminal, the first clock signal terminal and the second clock signal terminal;

the pull-down sub-circuit is connected to a second level terminal, a third level terminal, the idle output terminal, the output terminal, a first node, a second node, a third node and a fourth node, and is configured to make a voltage of the third node consistent with that of the second level terminal under the control of a signal of the first node, make voltages of the first node and the second node consistent with that of the second level terminal under the control of a signal of the third node, make a voltage of the output terminal consistent with that of the second level terminal under the control of the signal of the third node, make a voltage of the output terminal consistent with that of the third level terminal under the control of the signal of the third node, and make a voltage of the fourth node consistent with that of the third level terminal under the control of the signal of the third node;

the reset sub-circuit is connected to the reset terminal, the second level terminal, the first node and the second node, and is configured to make the voltages of the first node and the second node consistent with that of the second level terminal under the control of a signal of the reset terminal;

the idle output sub-circuit is connected to the first node, the second clock signal terminal and the idle output terminal, and is configured to output a signal of the second clock signal terminal at the idle output terminal under the control of the first node; and the output sub-circuit is connected to the first node, the second clock signal terminal and the output terminal, and is configured to output the signal of the second clock signal terminal at the output terminal under the control of the first node.

3. The gate driving circuit according to claim 2, wherein the idle output sub-circuit comprises: a first transistor, whose gate is connected to the first node, source is connected to the second clock signal terminal, and drain is connected to the idle output terminal.

4. The gate driving circuit according to claim 2, wherein the pull-up sub-circuit comprises: a first pull-up transistor, a second pull-up transistor, a third pull-up transistor, an fourth pull-up transistor, and a fifth pull-up transistor;

a gate and a source of first pull-up transistor are connected to the first level terminal, and a drain thereof is connected to the second node;

a gate and a source of the second pull-up transistor are connected to the signal input terminal, and a drain thereof is connected to the second node;

a gate of the third pull-up transistor is connected to the first node, a source thereof is connected to the second clock signal terminal, and a drain thereof is connected to the fourth node;

a gate of the fourth pull-up transistor is connected to the idle output terminal, a source thereof is connected to the second node, and a drain thereof is connected to the fourth node; and a gate of the fifth pull-up transistor is connected to the first clock signal terminal, a source thereof is connected to the second node, and a drain thereof is connected to the first node.

5. The gate driving circuit according to claim 2, wherein the pull-down sub-circuit comprises: a first pull-down transistor, a second pull-down transistor, a third pull-down transistor, an fourth pull-down transistor, a fifth pull-down transistor and a sixth pull-down transistor;

a gate of the first pull-down transistor is connected to the third node, a source thereof is connected to the idle output terminal, and a drain thereof is connected to the second level terminal;

a gate of the second pull-down transistor is connected to the first node, a source thereof is connected to the third node, and a drain thereof is connected to the second level terminal;

a gate of the third pull-down transistor is connected to the third node, a source thereof is connected to the first node, and drain thereof is connected to the second node;

a gate of the fourth pull-down transistor is connected to the third node, a source thereof is connected to the fourth node, and a drain thereof is connected to the third level terminal;

a gate of the fifth pull-down transistor is connected to the third node, a source thereof is connected to the output terminal, and a drain thereof is connected to the third level terminal; and a gate of the sixth pull-down transistor is connected to the third node, a source thereof is connected to the second node, and a drain thereof is connected to the second level terminal.

6. The gate driving circuit according to claim 2, wherein the reset sub-circuit comprises: first reset transistor and a second reset transistor, wherein a gate of the first reset transistor is connected to the reset terminal, a source thereof is connected to the first node, and a drain thereof is connected to the second node; and a gate of the second reset transistor is connected to the reset terminal, a source thereof is connected to the second node, and a drain thereof is connected to the second level terminal.

7. The gate driving circuit according to claim 2, wherein the output sub-circuit comprises an output transistor, whose gate is connected to the first node, source is connected to the second clock signal terminal, and drain is connected to the output terminal.

8. The gate driving circuit according to claim 2, wherein the first frame start signal is a single pulse signal and the second frame start signal is a multi-pulse signal.

9. The gate driving circuit according to claim 2, wherein m stages of GOA units are connected between the 2n-th stage of GOA unit and the (2n+2)-th stage of GOA unit in cascades.

10. The gate driving circuit according to claim 1, wherein m stages of GOA units are connected between the 2n-th stage of GOA unit and the (2n+2)-th stage of GOA unit in cascades.

11. A display circuit, comprising a pixel unit, a data voltage unit, and further comprising a first gate driving circuit and a second gate driving circuit;

wherein the first gate driving circuit is any one of the gate driving circuit according to claim 1;

the second gate driving circuit is any one of the gate driving circuit according to claim 1;

the first gate driving circuit is configured to input a first gate driving signal to the pixel unit;

the second gate driving circuit is configured to input a second gate driving signal to the pixel unit; and the pixel unit is configured to perform threshold compensating through the data voltage unit and display gray scale simultaneously under the control of the first gate driving signal and the second gate driving signal.

12. A display apparatus comprising the display circuit according to claim 11.

13. The display circuit according to claim 11, wherein the GOA unit comprises: a pull-up sub-circuit, a pull-down sub-circuit, a reset sub-circuit, an idle output sub-circuit and an output sub-circuit;

the pull-up sub-circuit is connected to the signal input terminal, a first level terminal, a first clock signal terminal, a second clock signal terminal, a first node, a second node, a third node and a fourth node, wherein the pull-up sub-circuit is configured to make a voltage of the first node consistent with that of the signal input terminal, make a voltage of the second node consistent with that of the signal input terminal or make the voltage of the second node consistent with a voltage of the fourth node, make a voltage of the third node consistent with a voltage of the first level terminal, and make the voltage of the fourth node consistent with a voltage of the first clock signal terminal under the control of signals of the signal input terminal, the first level terminal, the first clock signal terminal and the second clock signal terminal;

the pull-down sub-circuit is connected to a second level terminal, a third level terminal, the idle output terminal, the output terminal, a first node, a second node, a third node and a fourth node, and is configured to make a voltage of the third node consistent with that of the second level terminal under the control of a signal of the first node, make voltages of the first node and the second node consistent with that of the second level terminal under the control of a signal of the third node, make a voltage of the output terminal consistent with that of the second level terminal under the control of the signal of the third node, make a voltage of the output terminal consistent with that of the third level terminal under the control of the signal of the third node, and make a voltage of the fourth node consistent with that of the third level terminal under the control of the signal of the third node;

the reset sub-circuit is connected to the reset terminal, the second level terminal, the first node and the second node, and is configured to make the voltages of the first node and the second node consistent with that of the second level terminal under the control of a signal of the reset terminal;

the idle output sub-circuit is connected to the first node, the second clock signal terminal and the idle output terminal, and is configured to output a signal of the second clock signal terminal at the idle output terminal under the control of the first node; and the output sub-circuit is connected to the first node, the second clock signal terminal and the output terminal, and is configured to output the signal of the second clock signal terminal at the output terminal under the control of the first node.

14. The display circuit according to claim 13, wherein the idle output sub-circuit comprises: a first transistor, whose gate is connected to the first node, source is connected to the second clock signal terminal, and drain is connected to the idle output terminal.

15. A driving method of a display circuit, comprising steps of:

inputting a first gate driving signal to a pixel unit by a first gate driving circuit;

inputting a second gate driving signal to the pixel unit by a second gate driving circuit;

inputting a threshold compensating signal and a gray scale driving signal to the pixel unit by a data voltage unit; and controlling the pixel unit by the first gate driving signal and the second gate driving signal to perform threshold compensating according to the threshold compensating signal and display gray scale according to the gray scale driving signal simultaneously;

wherein both the first gate driving circuit and the second gate driving circuit are gate driving circuits according to claim 1.

16. The driving method according to claim 15, wherein the first gate driving signal and the second gate driving signal are multi-pulse signals.

* * * * *